US005791259A

United States Patent [19]

Mansfield et al.

[11] Patent Number: 5,791,259

[45] Date of Patent: Aug. 11, 1998

[54] ADJUSTABLE SHELF SUPPORT ASSEMBLY COMPUTER WORK STATION

[75] Inventors: Michael T. Mansfield, Mundelein; Ronald L. Wood, Jr., Barrington, both of Ill.

[73] Assignee: B & W Corporation, Bensenville, Ill.

[21] Appl. No.: 833,283

[22] Filed: Apr. 4, 1997

[51] Int. Cl.[6] ..... A47F 5/12

[52] U.S. Cl. ..... 108/6; 108/50.01

[58] Field of Search ..... 108/3, 4, 6, 50.01, 108/147.11, 147.21, 106, 107; 248/917, 918; 312/223.3, 21, 195, 208.1, 312

[56] References Cited

U.S. PATENT DOCUMENTS

| | | | |
|---|---|---|---|
| Re. 34,266 | 6/1993 | Schairbaum . | |
| 4,250,815 | 2/1981 | Swanson | 108/147.11 X |
| 5,044,284 | 9/1991 | Gross | 312/223.3 X |
| 5,071,204 | 12/1991 | Price et al. | 312/223.3 X |
| 5,125,727 | 6/1992 | Lechman et al. . | |
| 5,174,224 | 12/1992 | Nagy et al. | 108/6 X |
| 5,290,009 | 3/1994 | Lechman . | |
| 5,294,193 | 3/1994 | Wegman et al. . | |
| 5,364,177 | 11/1994 | Ugalde . | |
| 5,408,939 | 4/1995 | Lechman . | |
| 5,419,525 | 5/1995 | Hilton | 108/50.01 X |
| 5,437,235 | 8/1995 | Randolph . | |
| 5,480,224 | 1/1996 | Ugalde . | |
| 5,544,594 | 8/1996 | Schairbaum . | |

OTHER PUBLICATIONS

M & M Industries, Product Catalog (1994) cover and pp. 6 and 7 (to be viewed side-by-side).

Studio, Product Catalog (1995) cover and p. 8.

Office Specialty, Platform.

*Primary Examiner*—Jose V. Chen

*Attorney, Agent, or Firm*—James P. Hanrath

[57] ABSTRACT

An adjustable shelf support assembly comprises a first side body, a second side body, a support member extending between and secured to the side bodies, and a shelf. The shelf has a pair of support brackets attached to its underside surface. The support brackets each have a pair of aligned openings, each opening defining an open vertical channel adjacent a plurality of downwardly extending fingers and a plurality of seating apertures neighboring said downwardly extending fingers. The support brackets are capable of a selective and removable mounting of the seating apertures upon the support member to thereby adjust the vertical setting of the shelf or to tilt the shelf.

18 Claims, 8 Drawing Sheets

ADJUSTABLE SHELF SUPPORT ASSEMBLY COMPUTER WORK STATION

BACKGROUND OF THE INVENTION

1. Field of the Invention

The present invention relates generally to computer work stations and more particularly to an adjustable shelf support assembly of a computer work station whereby a shelf or platform for a computer monitor, is vertically adjustable and/or capable of being set in a tilted fashion relative a vertically adjustable keyboard platform of the computer work station.

2. Description of the Related Art

A variety of computer work stations are currently available which are designed to use computers in close proximity with associated pieces of computer or printer equipment for easier use. The widespread use of computers in office applications has given rise to a new generation of office furniture. This furniture is designed to accommodate and provide flexibility in the positioning of desk top computers and the wiring for the computers. Some mechanisms provide for keyboard adjustment while other mechanisms provide for monitor adjustments, and still other mechanisms provide other types of adjustments. Many such adjustments are so complicated and expensive, they can only be used in high cost computer furniture.

The present invention includes an adjustable shelf support assembly for an improved computer work station which provides a selective vertical and/or tilting adjustability of a monitor platform independent of a vertical adjustability of a keyboard platform of the furniture.

SUMMARY OF THE INVENTION

In accordance with the present invention there is provided an adjustable shelf support assembly comprising a first side body and a second side body; a support member extending between and secured to the first and second side bodies; a shelf; and a pair of support brackets attached to the self, preferably an underside surface of the shelf, each of the support brackets having a pair of aligned openings, each opening defining an open vertical channel adjacent a plurality of downwardly extending fingers and a plurality of seating apertures neighboring the downwardly extending fingers. The pair of support brackets are capable of a selective and removable mounting of the seating apertures upon the support member to thereby adjust the vertical setting of the shelf or to tilt the shelf.

The adjustable shelf support assembly of the present invention is suited for incorporation into a stand-alone or tabletop computer work station. In this regard, the shelf of the adjustable shelf support assembly is preferably used to support a computer monitor upon a shelf wherein the position of the shelf can be adjusted vertically or tilted to thereby provide a selective setting of the monitor via the computer operator.

The present invention advantageously provides an ergonomic design to a computer work station such that the monitor support shelf can be adjusted vertically and/or tilted independent of a keyboard support shelf or a vertically adjustable keyboard support shelf.

Additional features and advantages of the present invention will become apparent to those skilled in the art from the following description and the accompanying figures illustrating preferred embodiments of the invention, the same being the present best mode for carrying out the invention.

DESCRIPTION OF THE PREFERRED EMBODIMENTS

Figure 1:
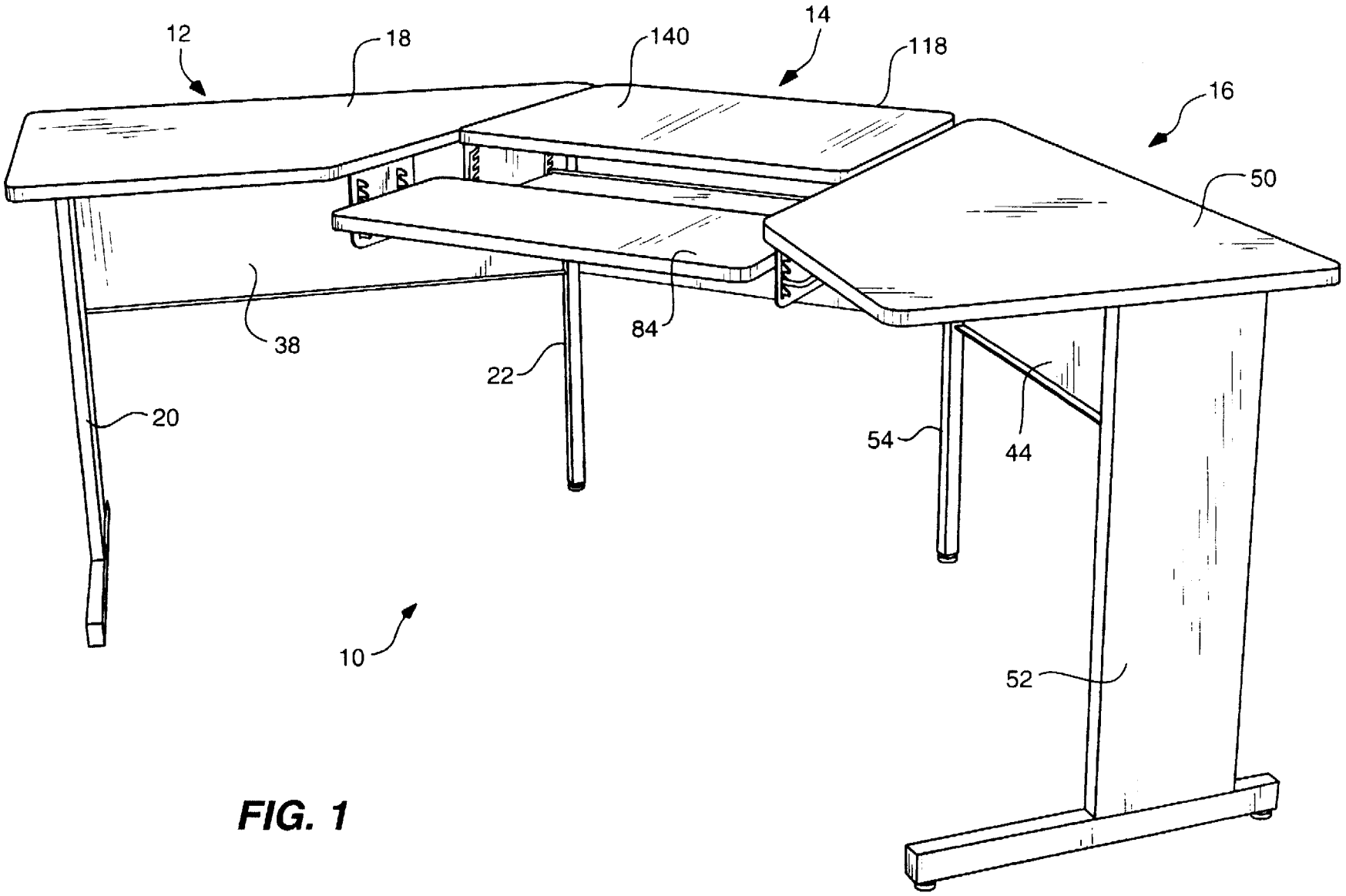
FIG. 1 is a front perspective view of a computer work station constructed in accordance with the teachings of the present invention.

Referring now to the drawings, there is shown in FIG. 1 a front perspective view of a computer work station constructed in accordance with the teachings of the present invention. Computer work station 10 includes a left side portion 12, a middle portion 14, and a right side portion 16.

Figure 2:
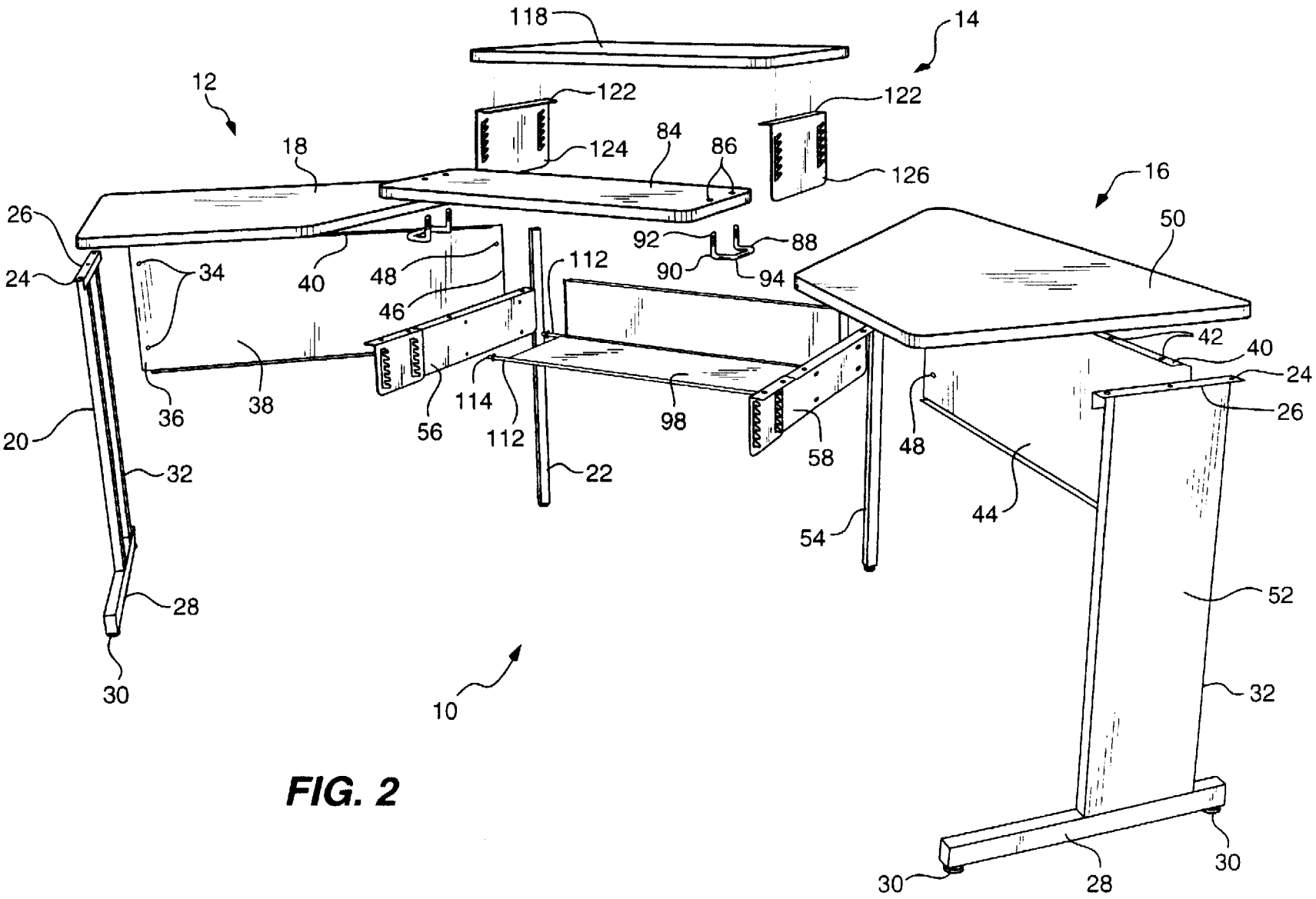
FIG. 2 is a front perspective view of the computer work station shown in FIG. 1 with the component parts thereof exploded.

As better observed in the exploded view of FIG. 2, the computer work station 10 is composed of component parts forming left side portion 12, middle portion 14, and right side portion 16. In particular, left side portion 12 includes left tabletop 18 which is securable to outer left leg 20 and inner left leg 22 by suitable screw, nut, or other attachment means known in the art. For example, the underside surface of left tabletop 18 may include drill holes which may be aligned over corresponding holes 24 of a top support surface 26 of outer left leg 20 such that the same can be secured by screws. Outer left leg 20 may be supported by a foot brace 28 having an end cap 30. Similarly, a rear edge 32 of outer left leg 20 may be provided with holes which can be cooperatively aligned with holes 34 of left side flange 36 of left panel 38 to thereby secure the left panel to the outer left leg by screws or other attachment means known in the art. An upper support edge 40 of left panel 38 likewise may be provided with a plurality of holes 42 (see right panel 44 at FIG. 2) which can be cooperatively aligned with drill holes at the underside rear periphery of left tabletop 18 to thereby screw secure left tabletop 18 to the upper support edge 40 of left panel 38. Left panel 38 also has a right side flange 46 having a plurality of holes 48 which can be aligned and screw set to inner left leg 22.

The right side section 16 of computer work station 10 is a mirror image of the left side portion 12 heretofore described. The right tabletop 50 is supported via outer right leg 52, right panel 44, and inner right leg 54 in a manner as heretofore described.

The middle section 14 of the computer work station 10 includes a left keyboard support bracket 56 and a right keyboard support bracket 58. As better observed at FIG. 4, the keyboard support brackets have an outwardly extending upper support surface 60 having a plurality of holes 62 which can be cooperatively aligned with drill holes at the underside inwardly facing peripheries of left tabletop 18 and right tabletop 50 to thereby screw secure left keyboard support bracket 56 to left tabletop 18 and right support keyboard bracket 58 to right tabletop 50. In addition, distal ends 64 and 66 of left keyboard support bracket 56 and right keyboard support bracket 58 respectively, can be provided with vertically aligned holes 68 cooperative with holes in inner left leg 22 and inner right leg 54 to thereby also screw secure the left and right keyboard brackets to the inner legs.

Figure 4:
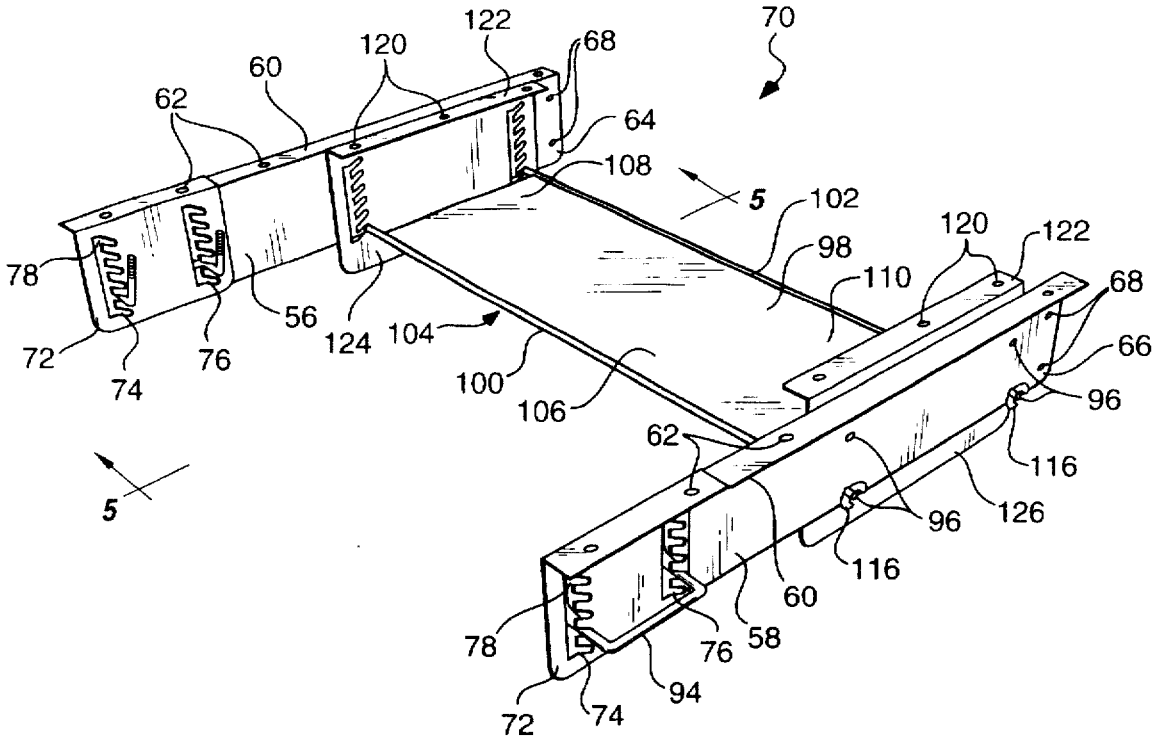
FIG 4 is a side perspective view of a monitor support bracket and keyboard support bracket assembly for the computer work station shown in FIG. 1.

FIG. 4 illustrates a side perspective view of a monitor support bracket and keyboard support bracket assembly 70 for the computer work station 10 shown in FIG. 1. The left keyboard support bracket 56 and the right keyboard support bracket 58 each include a proximal end portion 72 having a pair of aligned openings 74 and 76, each opening defining an open vertical channel 78 adjacent a plurality of upwardly extending fingers 80 forming a plurality of seating apertures 82 neighboring the upwardly extending fingers. When the left keyboard support bracket 56 and right keyboard support bracket 58 are screw set to their tabletops and inner legs respectively, each of their pairs of aligned openings are disposed in a cooperatively aligned manner across from each other to accommodate a vertically adjustable selective setting of keyboard shelf 84 (see FIG. 1 and 2). As observed at FIG. 2, the keyboard shelf 84 has drills holes 86 at each of its side ends which can receive cooperative keyboard shelf hangers 88. The keyboard shelf hangers 88 each include an upwardly extending portion 90 which upwardly terminates in a threaded end 92 and downwardly terminates into an outwardly extending portion 94. When keyboard shelf hangers 88 are inserted through the pair of aligned openings 74 and 76 of left keyboard support bracket 56 and right keyboard support bracket 58, the upwardly extending portions 90 of the shelf hangers 88 can be aligned with and extended through the holes 86 of the keyboard shelf 84 for threaded mating or cooperation with a suitable nuts to thereby secure the shelf hangers to the keyboard. Once the shelf hangers are so mated to the keyboard, the outwardly extending portions 94 of shelf hangers 88 may be selectively and removably mounted upon the seating apertures 82 neighboring the upwardly extending fingers 80 of the keyboard support brackets. Open vertical channel 78 of the aligned openings 74 and 76 of the keyboard support brackets accommodate vertical movement of the shelf hangers 88 for the removable selection of a pair of seating apertures 82, among the plurality of seating apertures 82, to thereby vertically adjust the setting of keyboard shelf 84 in computer work station 10.

The keyboard brackets 56 and 58 each preferably have a vertically aligned plurality of horizontally aligned apertures 96 which cooperate with a support member 98 to support an adjustable shelf support assembly for the support of, for example, a computer monitor upon a shelf. As best observed at FIG. 4, support member 98 is dimensioned to cooperatively and removably seat within a selected pair of the horizontally aligned apertures 96 to extend between the keyboard brackets 56 and 58. Although the support member may be formed of a pair of connection rods 100 and 102, the support member preferably comprises a plate 104 having a body section 106 with a left side portion 108, a right side portion 110, and a pair of extension members 112 (see FIG. 1) at each of the side portions of the body section 106. The extension members may be threaded at their outer ends 114 and are dimensioned to cooperatively and removably seat within a pair of the horizontally aligned apertures 96 of the keyboard brackets 56 and 58 (preferably a selected pair among a plurality of such pairs) so as to be secured thereto by wingnuts 116 or other means known in the art. The plurality of pairs of horizontally aligned apertures 96 are vertically aligned to provide multiple locations for the seating of the support member 98 at various vertical positions relative keyboard brackets 56 and 58. The ability to select one of the horizontally aligned aperture pairs among such multiple positions provides a greater range of vertical adjustability to the adjustable shelf support assembly.

Once seated, support member 98 serves as a base for a monitor shelf bracket assembly. Referring now to FIGS. 2 and 4, monitor shelf 118 has a plurality of drill holes to the underside periphery of its left side and right side portions for cooperative alignment with a plurality of holes 120 in the upper ledge 122 of left monitor support bracket 124 and right monitor support bracket 126 to enable the monitor support brackets to be attached to the monitor shelf by screws or other attachment means known in the art.

Figure 5:
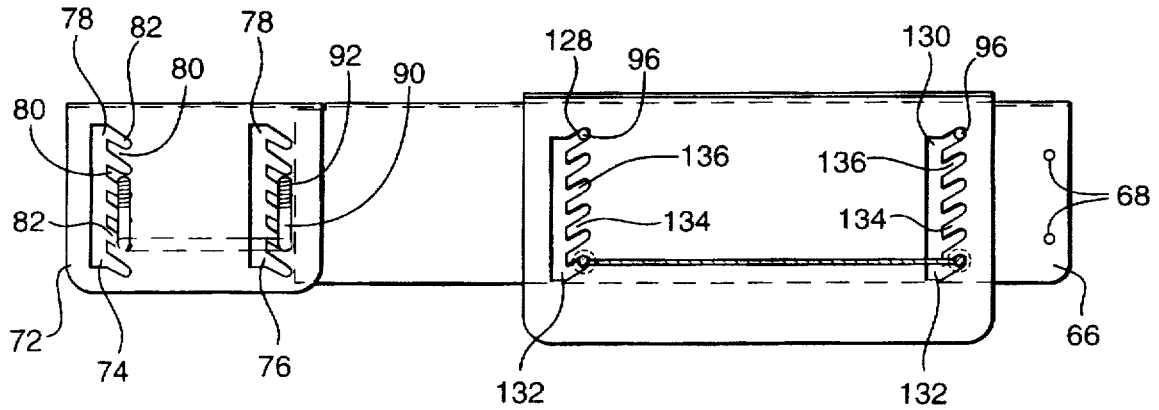
FIG. 5 is a side view of the monitor support bracket and keyboard support bracket assembly taken along line 5—5 of FIG. 4.

As best observed at FIGS. 4 and 5, the left monitor support bracket 122 and right monitor support bracket 126 each have a pair of aligned openings 128 and 130, each opening defining an open vertical channel 132 adjacent a plurality of downwardly extending fingers 134 forming a plurality of seating apertures 136 neighboring the downwardly extending fingers. The monitor support brackets 122 and 124 thus define means for seating themselves, and thereby the monitor shelf 118, upon support member 98 via a selective and removable mounting of an elected pair of the seating apertures 136 upon the support member 98 to thereby either adjust the vertical setting of the monitor shelf or to tilt the monitor shelf. In this regard, the aligned openings 128 and 130 of each monitor support bracket may be positioned to dispose open vertical channel 132 above the extension members 112 of support member 98 to allow a selective movement along the vertical height of the open vertical channel until the user selects a pair among the plurality of seating apertures neighboring the downwardly extending fingers to seat upon the extension members of the support member. The selected pair of seating apertures can be correspondingly horizontally aligned in which case merely the vertical setting of the monitor shelf is determined. If the selected pair of seating apertures are not horizontally aligned then seating of the support bracket upon the extension members of the support member will tilt the monitor shelf in a selected forward direction (the distal edge of the monitor shelf is higher than the proximal edge) or a selected rearward direction (the proximal edge of the monitor shelf is higher than the distal edge) orientation. The degree of tilt is dependent on the degree to which the selected pair of seating apertures are not horizontally aligned. Monitor shelf 118 can be provided with a monitor backstop or a monitor forestop atop the shelf to prevent movement of the monitor as a result of a more extreme tilted selected position of the monitor shelf.

Figure 3:
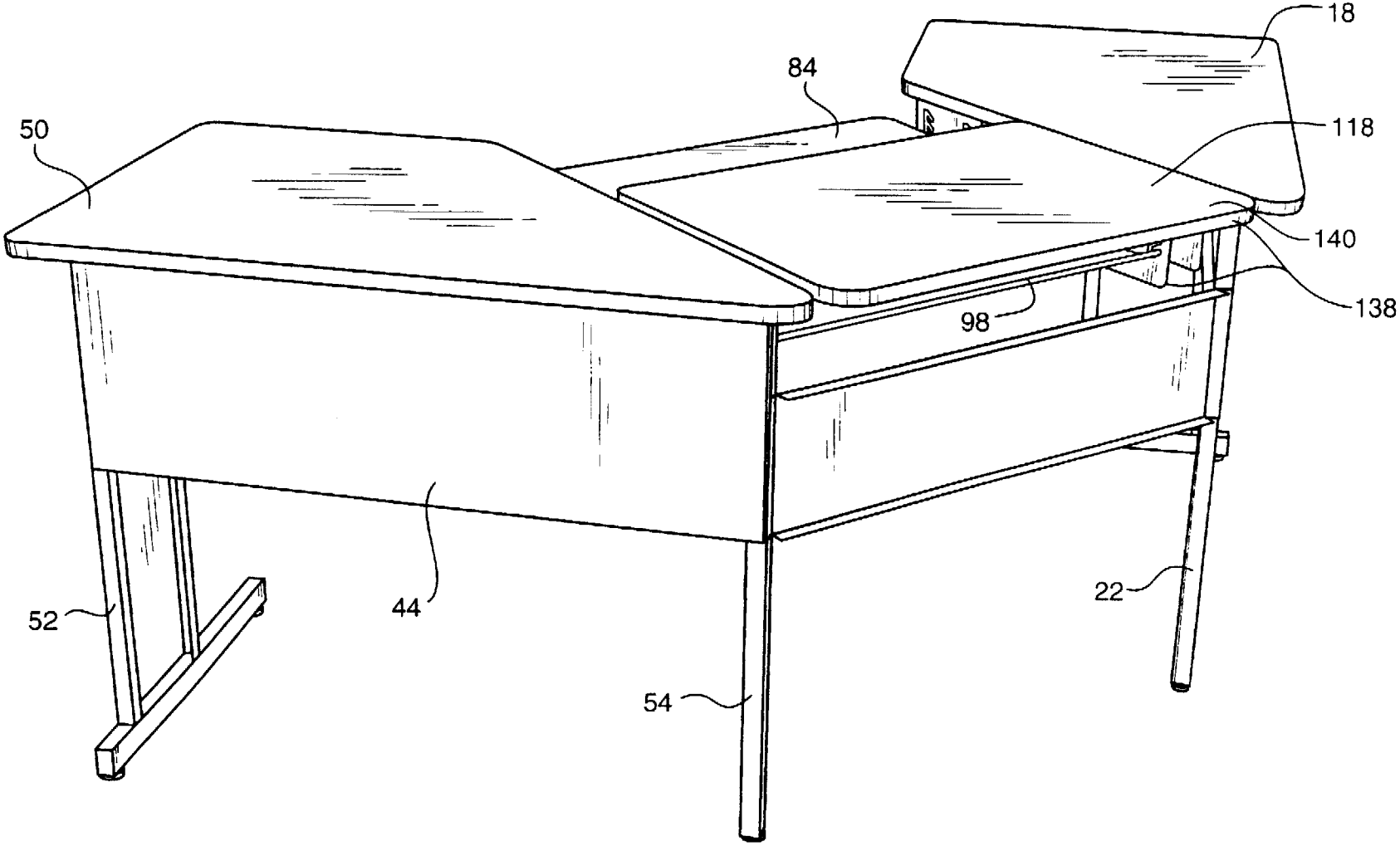
FIG. 3 is a side perspective view of the computer work station shown in FIG. 1.
Figure 6:
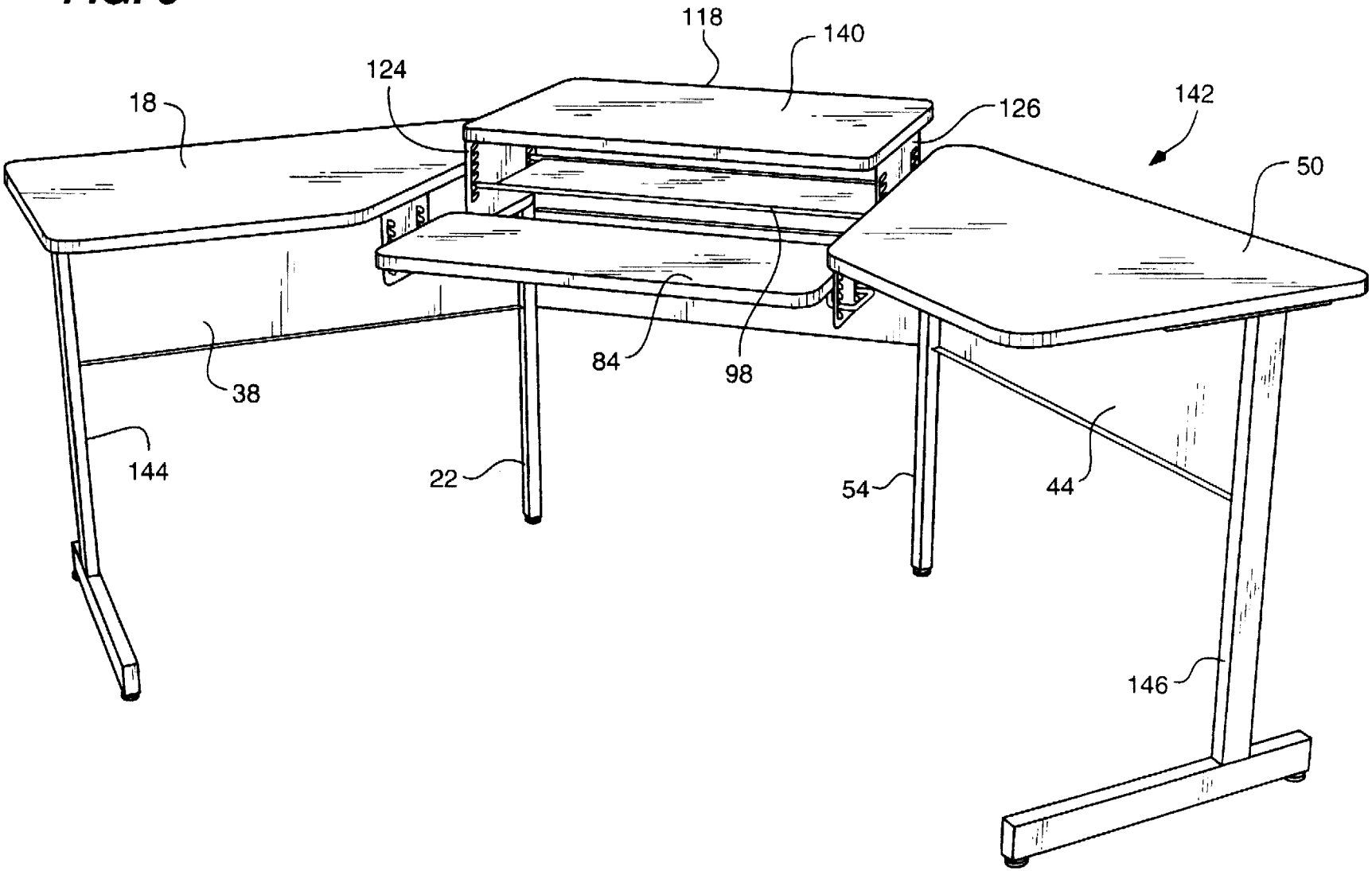
FIG. 6 is a front perspective view of a second embodiment of the computer work station constructed in accordance with the teachings of the present invention, now illustrating the monitor support shelf set in a raised position.

In the front perspective view of FIG. 1 and the side perspective view of FIG. 3, the computer work station 10 is illustrated with the adjustable shelf support assembly 138 seated upon support member 98 placed into a lower elected pair of the horizontally aligned seating apertures 96 to thereby set top surface 140 of monitor shelf 118 in horizontally alignment with left tabletop 18 and right tabletop 50 of the computer work station. FIG. 6 is front perspective view of a second embodiment of a computer work station constructed in accordance with the teachings of the present invention which shows computer work station 142 merely modified at outer left leg 144 and outer right leg 146, each of which now is illustrated with a more streamlined side profile appearance as compared to the presentation of such legs in FIG. 1.

Figure 7:
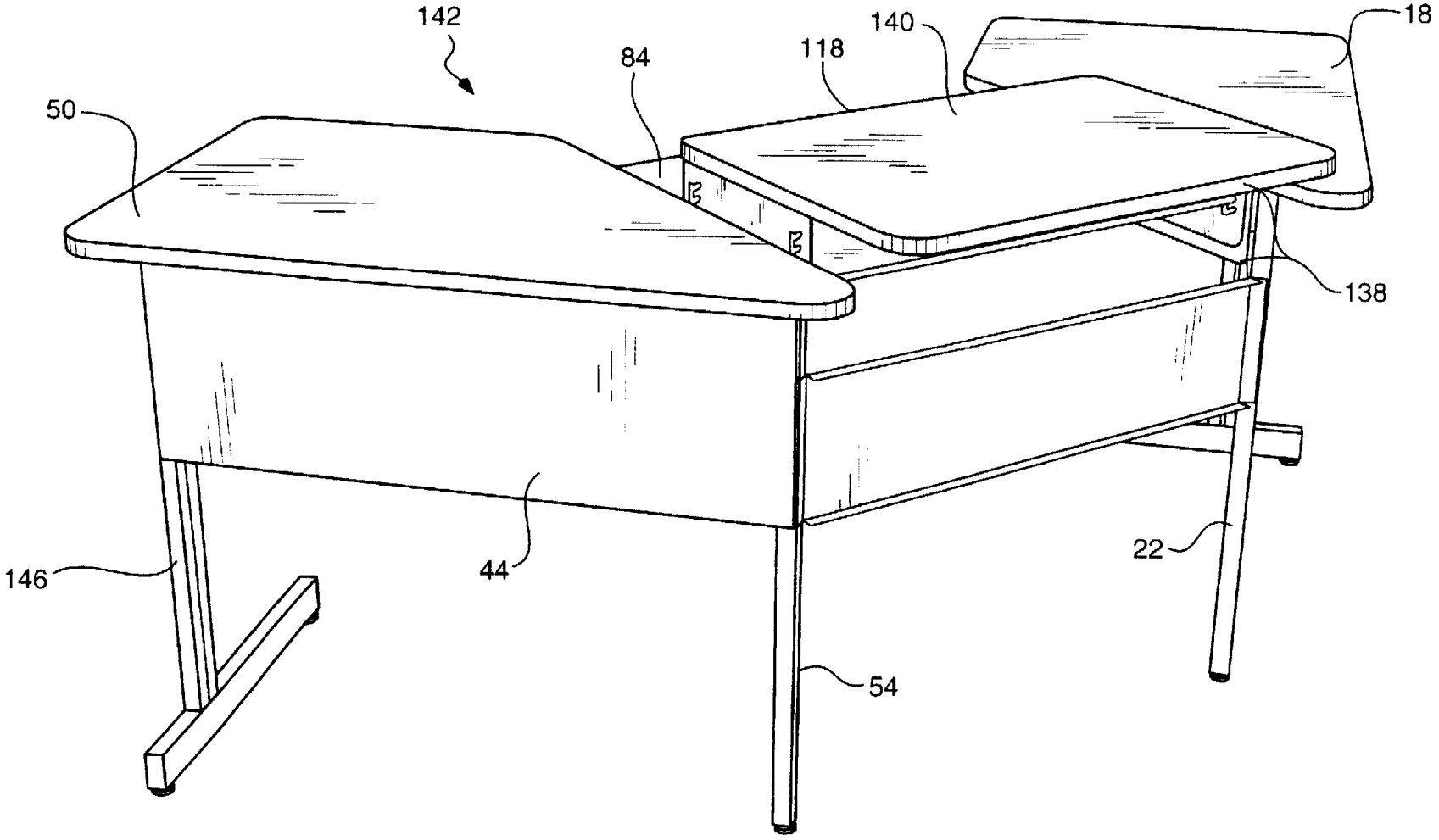
FIG. 7 is a side perspective view of the computer work station shown in FIG. 6.

FIG. 6 further illustrates support member 98 being seated at a vertically higher pair of the horizontally aligned seating apertures 96 of the left and right keyboard support brackets such that the left monitor support bracket 124 and right monitor support bracket 126 may be seated upon support member 98 (via a selection of the seating apertures 136 neighboring the downwardly extending fingers 134 of the monitor support brackets) to thereby dispose the top surface 140 of monitor shelf 118 in a raised position relative left tabletop 18 and right tabletop 50. FIG. 7 is a side perspective view of the computer work station 142 illustrated in FIG. 6.

Figure 8:
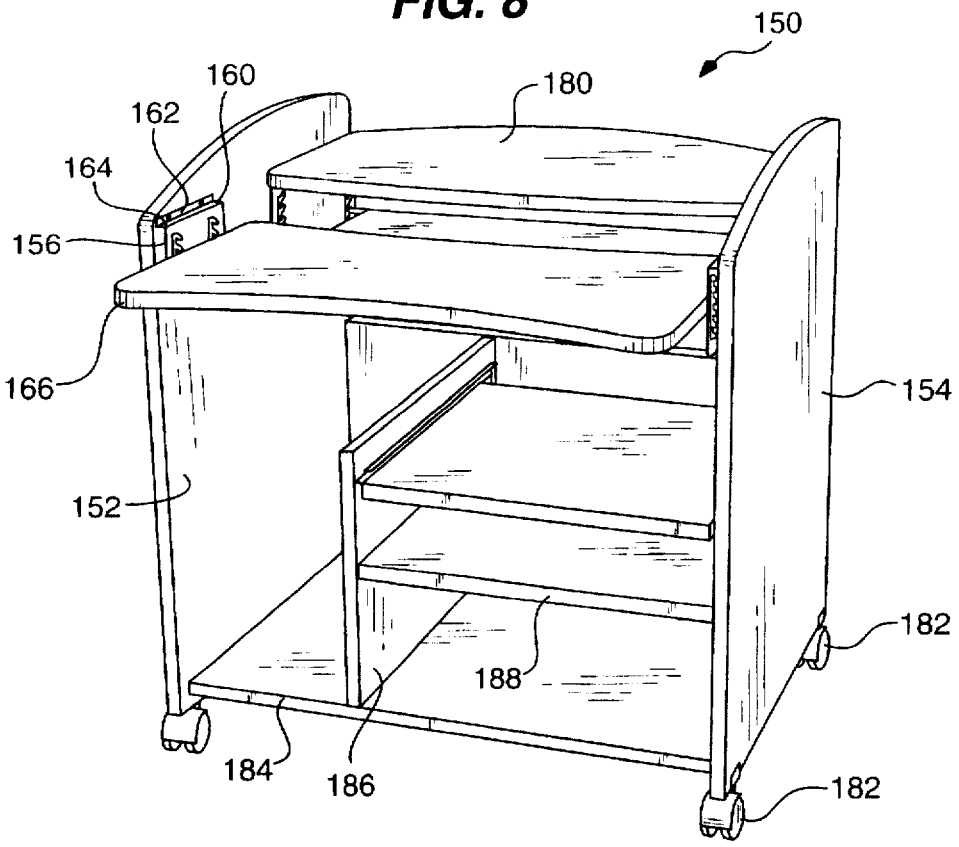
FIG. 8 is a front perspective view of a third embodiment of the computer work station constructed in accordance with the teachings of the present invention.
Figure 9:
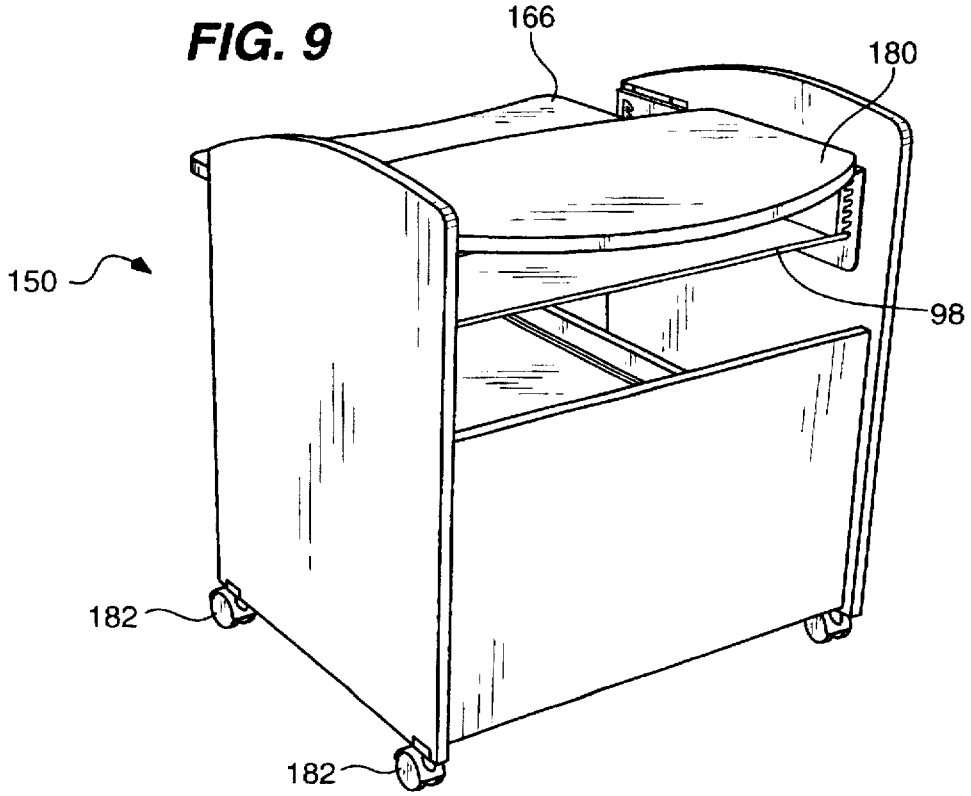
FIG. 9 is a rear perspective view of the computer work station shown in FIG. 8.
Figure 10:
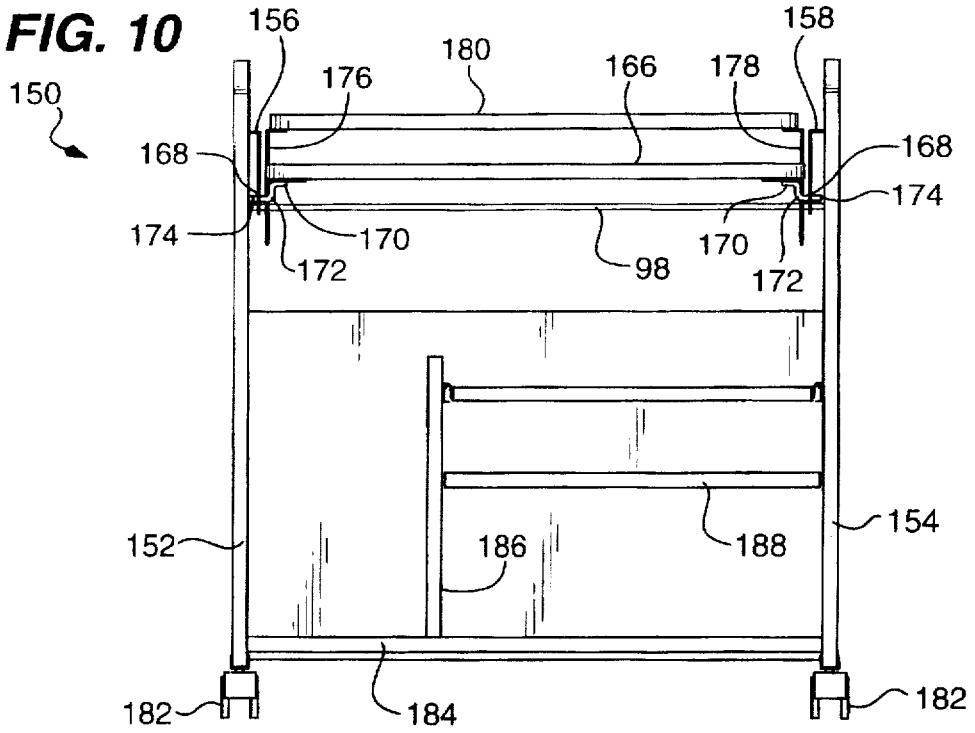
FIG. 10 is a front view of the computer work station shown in FIG. 8
Figure 11:
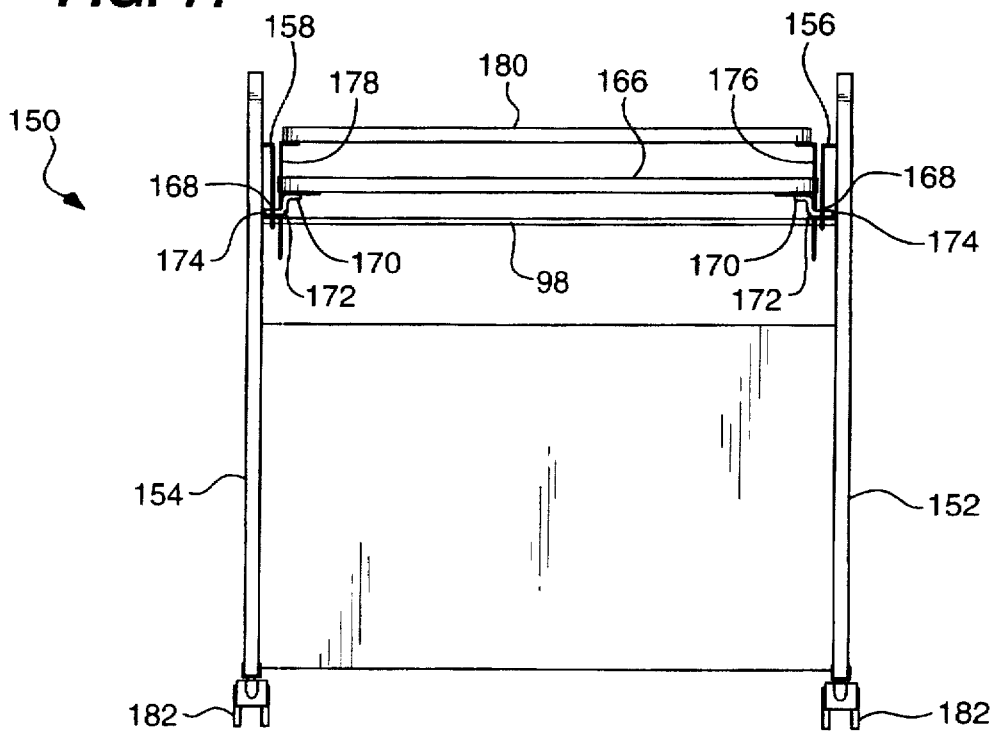
FIG 11 is a rear view of the computer work station shown in FIG. 8.

FIGS. 8 through 11 illustrate a third embodiment of a computer work station constructed in accordance with the teachings of the present invention. Computer work station 150 operates in like fashion to the middle portion 14 of computer work station 10 illustrated at FIG. 1 but is now a mobile stand alone unit. In the front perspective view of FIG. 8, computer work station 150 includes a monitor support bracket and keyboard support bracket assembly mounted to a left cart wall 152 and right cart wall 154. As better observed in the front view of FIG. 10 and the rear view of FIG. 11, left keyboard bracket 156 and right keyboard bracket 158 are attached to the interior facing surface of left cart wall 152 and right cart wall 154 respectively. In this regard, FIG. 8 illustrates the keyboard brackets to have an upper edge 160 which terminates into an upwardly extending mounting flange 162 having a plurality of holes 164 for screw or other known means of attachment. The keyboard brackets 156 and 158 each have a pair of aligned openings 74 and 76, each opening defining and open vertical channel 78 adjacent a plurality of upwardly extending fingers 80 forming a plurality of seating apertures 82 neighboring the upwardly extending fingers in a manner as heretofore described. As illustrated in FIGS. 10 and 11, keyboard shelf 166 has left and right keyboard shelf hangars 168 having an upper inwardly extending portion 170 screwed to and supporting the undersigned surface of keyboard shelf 166 integral with a downwardly extending portion 172 which terminates into a outwardly extending portion 174. Once the shelf hangers 168 are inserted through the keyboard support brackets 152 and 158 and then mated to the keyboard the outwardly extending portions 174 may be selectively and removably mounted upon the seating apertures 82 neighboring the upwardly extending fingers 80 of the keyboard support brackets in a manner as heretofore described.

The monitor support assembly of computer work station 150 includes left monitor support bracket 176 and right monitor support bracket 178 mounted to an underside surface of monitor shelf 180 in a manner heretofore described. Each of the monitor support brackets have the pair of aligned openings 128 and 130 previously described, each of these openings defining an open vertical channel 132 adjacent a plurality of downwardly extending fingers 134 forming a plurality of seating apertures 136 neighboring the downwardly extending fingers. As heretofore described the monitor support brackets 176 and 178 can seat themselves, and thereby the monitor shelf 180, upon support member 98 of computer work station 150. The support member 98 may be formed of a pair of connection rods or, as illustrated in FIGS. 8 through 11, as a plate 104 having a body section 106 with a left side portion 108, a right side portion 110 and a pair of extension members 112 at each of the side portions of the body section heretofore described in relation to FIGS. 4 and 5. The extension members are dimensioned to extend into a pair of horizontally aligned apertures drilled into the interior surface of left cart wall and right cart wall to thereby removably attach support member 98 to the left cart wall 152 and the right cart wall 154. Preferably the left and right cart walls have a plurality of pairs of horizontally aligned apertures which are vertically aligned thereby providing multiple positions for the vertical setting of support member 98.

Computer work station 150 may be provided with wheels 182 at the bottom edge of left cart wall 152 and right cart wall 154 to provide mobility to the same and may be further provided with a base surface 184 and vertical and/or horizontal compartmental dividers 186 and 188, respectively, to organize space within the same.

From the foregoing description, it will be apparent that the adjustable shelf support assembly computer work station of the present invention has a number of advantages, some of which have been described above and others of which are inherent in the invention. Also, it will be understood that modifications can be made to the adjustable shelf support assembly computer work station or its environment of use described above without departing from the teachings of the present invention. Accordingly, the scope of the invention is only to be limited as necessitated by the accompanying claims.

We claim:

1. An adjustable shelf support assembly comprising a first side body and a second side body;

a support member extending between and secured to said first and second side bodies;

a shelf;

a pair of support brackets attached to said shelf, each of said support brackets having a pair of aligned openings, each opening defining a vertical channel adjacent a plurality of downwardly extending fingers and a plurality of seating apertures neighboring said downwardly extending fingers, each of said vertical channels defining a cooperative opening which is moveable upon movement of said support brackets to accommodate a selected and removable seating of a selected horizontally aligned or horizontally unaligned pair of said seating apertures upon said support member to thereby adjust a vertical setting of said shelf or to tilt said shelf.

2. The adjustable shelf support assembly of claim 1 wherein said pair of support brackets are attached to an underside surface of said shelf.

3. The adjustable shelf support assembly of claim 1 wherein said first side body and said second side body each have at least one pair of horizontally aligned apertures and said support member is dimensioned to cooperatively and removably seat within said apertures of said side bodies.

4. The adjustable shelf support assembly of claim 3 wherein said support member comprises a plate having a body section including a left side portion, a right side portion, and a pair of extension members at each of said side portions of said body section, said extension members being dimensioned to cooperatively and removably seat within said apertures of said side bodies.

5. The adjustable shelf support assembly of claim 3 wherein said first side body and said second side body each have a plurality of pairs of horizontally aligned apertures which are vertically aligned to provide multiple locations for seating of said support member.

6. The adjustable shelf support assembly of claim 1 wherein said downwardly extending fingers terminate into an inwardly extending flange.

7. The adjustable shelf support assembly of claim 1 wherein said first side body and said second side body comprise a pair of second support brackets, each of said second support brackets being attached to a table.

8. The adjustable shelf support assembly of claim 7 wherein said pair of second support brackets are attached to an underside surface of said table.

9. The adjustable shelf support assembly of claim 7 wherein each of said second support brackets has a pair of aligned openings, each opening defining a vertical channel adjacent a plurality of upwardly extending fingers and a plurality of seating apertures neighboring said upwardly extending fingers.

10. The adjustable shelf support assembly of claim 9 further including a keyboard shelf supported by said second support brackets.

11. The adjustable shelf support assembly of claim 7 wherein said table includes at least one support leg supporting said table.

12. The adjustable shelf support assembly of claim 1 wherein said first side body and said second side body comprise opposed side walls.

13. The adjustable shelf support assembly of claim 12 further including pair of second support brackets, one of each of said pair of second support brackets being attached to one of each of said side walls.

14. The adjustable shelf support assembly of claim 13 wherein each of said second support brackets has a pair of aligned openings, each opening defining a vertical channel adjacent a plurality of upwardly extending fingers and a plurality of seating apertures neighboring said upwardly extending fingers.

15. The adjustable shelf support assembly of claim 14 further including a keyboard shelf, a pair of keyboard shelf hangers removably attached to said keyboard shelf, each of said vertical channels defining a cooperative opening which accommodates a movement of said keyboard shelf hangers to achieve a selected and removable seating of said keyboard shelf hangers within a selected pair of said seating apertures to thereby adjust the vertical setting of said keyboard shelf relative said second support brackets.

16. The adjustable shelf support assembly of claim 12 wherein said opposed side walls include wheels at a bottom edge thereof.

17. The adjustable shelf support assembly of claim 12 wherein said opposed side walls border a base surface extending therebetween.

18. The adjustable shelf support assembly of claim 17 wherein said base surface supports one or more dividing walls disposed between said opposed side walls to compartmentalize the space between said opposed side walls.

* * * * *